US006167599B1

(12) United States Patent
Chen

(10) Patent No.: US 6,167,599 B1
(45) Date of Patent: Jan. 2, 2001

(54) LIGHT REFLECTING TAG ATTACHED TO ENDS OF A SHOELACE

(75) Inventor: Paul Chen, Changhua Hsien (TW)

(73) Assignee: Taiwan Paiho Limited, Changhua Hsien (TW)

( * ) Notice: Under 35 U.S.C. 154(b), the term of this patent shall be extended for 0 days.

(21) Appl. No.: 09/288,818

(22) Filed: Apr. 9, 1999

(51) Int. Cl.[7] ..... A44C 11/02
(52) U.S. Cl. ..... 24/715.4; 24/712
(58) Field of Search ..... 24/715.4, 715.5, 24/715.6, 715.7, 712; 40/316; 87/1; 359/518; 36/137

(56) References Cited

U.S. PATENT DOCUMENTS 1,512,162 * 10/1924 Dennis ..... 24/715.7 X
4,651,447 * 3/1987 Sullivan ..... 24/715.4 X
5,619,778 * 4/1997 Sloot ..... 24/715.4
5,722,757 * 3/1998 Chien ..... 36/137 X
5,879,069 * 3/1999 Chien ..... 36/137 X

* cited by examiner

*Primary Examiner*—Robert J. Sandy
(74) *Attorney, Agent, or Firm*—Dougherty & Troxell

(57) ABSTRACT

A light reflecting tag for use on ends of a shoelace is made up of a transparent plastic plate, a light reflecting plate and a thin transparent film. The light reflecting plate has one side provided with faceful bead protrusions and the other side with adhesive glue. The side with bead protrusions is first adhered to an inner face of the transparent plastic plate and then the thin transparent film is stuck to the light reflecting on the side with adhesive glue and also to the inner face of the transparent plastic plate. Such an assembly produces a light reflecting tag plate which is then wrapped around ends of a shoelace, making a wearer of wearing a pair of shoes with shoelaces provided with light reflecting plates better protective from accidents when moving outdoors in the dark.

2 Claims, 4 Drawing Sheets

LIGHT REFLECTING TAG ATTACHED TO ENDS OF A SHOELACE

BACKGROUND OF THE INVENTION

The present invention relates to an improved tag for use on ends of a shoelace. Each tag is made up of a transparent plastic plate, a light reflecting plate and a thin transparent film. The light reflecting plate has one side provided with faceful bead protrusions and the other side with adhesive glue. The side with bead protrusions is first adhered to an inner face of the transparent plastic plate and then the thin transparent film is stuck to the light reflecting on the side with adhesive glue and also to the inner face of the transparent plastic plate. Such an assembly produces a light reflecting tag plate which is then wrapped around ends of a shoelace, making a wearer of wearing a pair of shoes with shoelaces provided with light reflecting plates better protective from accidents when moving outdoors in the dark.

The tag plate of the present invention wrapped in a cylindrical tube around ends of a shoelace not only facilitates the shoelace to be led through eyelets of a shoe but also provides safety to wearers due to its light reflecting property in the dark.

As shown in FIGS. 1, 2, a prior art tag is a transparent plastic plate 20 of acetate fiber having one inner side coated with acetone. It is secured to the surface of each end 11 of a shoelace and is softened by a heat source and is pressed tight by a mold to permit the tag to be wrapped around the end 11 in a cylindrical form. This permits a shoelace to be easily led through eyelets of a shoe by way of the tags.

The conventional tags are designed only to facilitate the arrangement of shoelaces on shoes and no other functions are found. So, the present inventor noticing the disadvantage of the prior art tag and comes up with an improved tag which can reflect light in the dark in addition.

SUMMARY OF THE INVENTION

Therefore, the primary object of the present invention is to provide a light reflecting tag plate secured to ends of a shoelace which can reflect light in the dark. A person wearing a pair of shoes mounted with shoelaces equipped with tags of the present invention can walk and exercise outdoors in a safer manner.

Another object of the present invention is to provide an improved tag plate, which can reflect light in the dark so as to make the appearance of a pair of shoes appeal to eyes of people.

DETAILED DESCRIPTION OF THE PREFERRED EMBODIMENT

Figure 1:
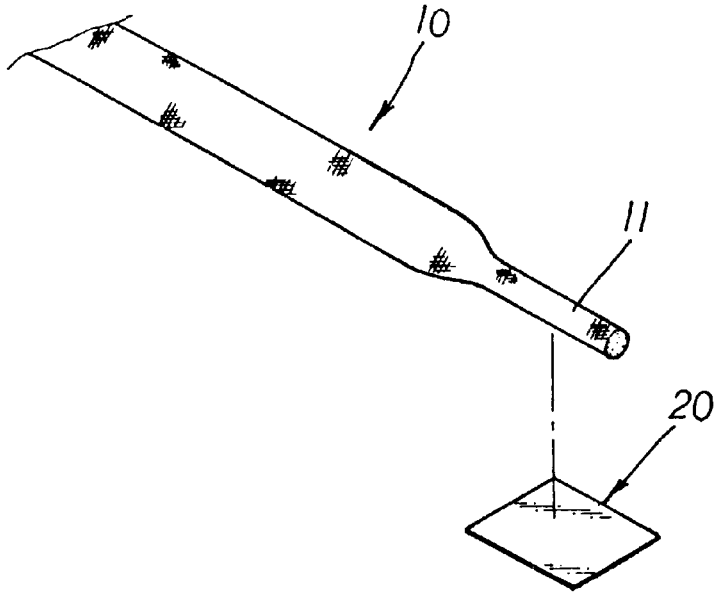
FIG. 1 PRIOR ART
FIG. 1 is a diagram showing the conventional tag plate for a shoelace.
Figure 2:
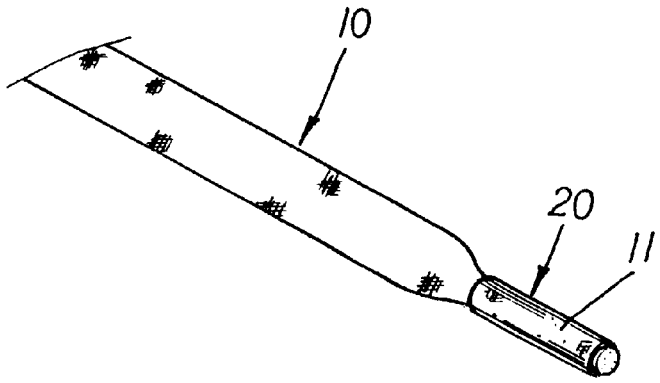
FIG. 2 PRIOR ART
FIG. 2 is a diagram showing the securing of the prior art tag to an end of a shoelace.
Figure 4:
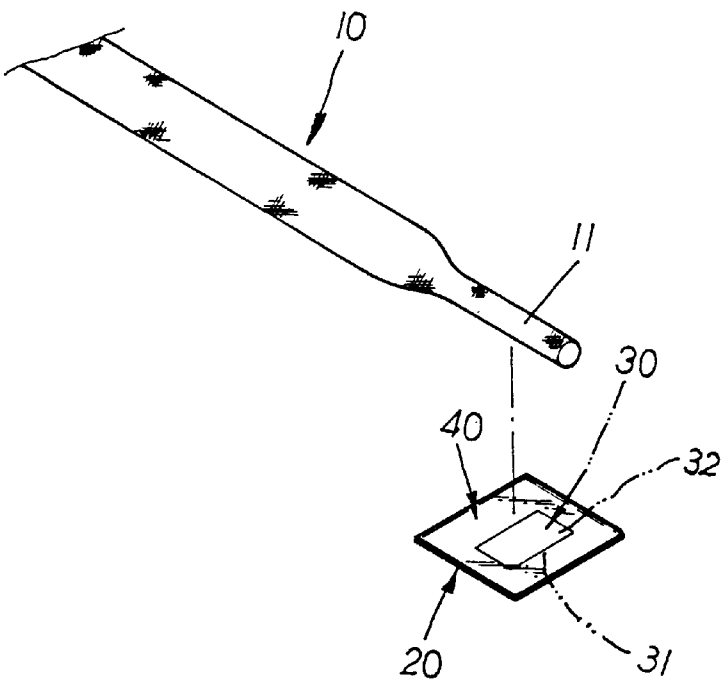
FIG. 4 is a diagram showing the tag assembly of the present invention.
Figure 3:
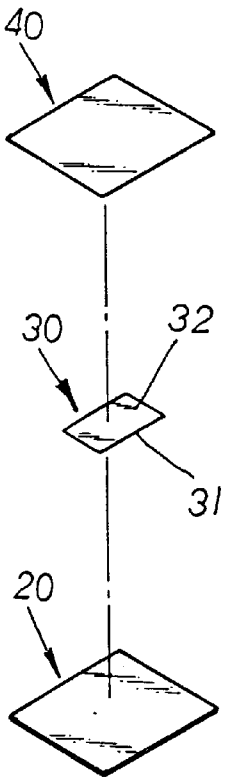
FIG. 3 is a perspective diagram showing the exploded components of the tag of the present invention.

Referring to FIG. 3, the diagram illustrates the exploded components of the present invention. The tag is comprised of a transparent plastic plate 20 of acetate fiber, a light reflecting plate 30 and a transparent film 40. The light reflecting plate 30 has one side 31 provided with faceful bead protrusions and the other side 32 is coated with adhesive glue. The light reflecting plate 30 is stuck by glue to the central area of an inner face of the transparent plastic plate 30 with its side 31 full of bead protrusions, as shown in FIG. 4. Then, the thin transparent film 40 in the same size as the transparent plastic plate 20 is sprayed with acetone and is stuck to the adhesive coated side 32 of the light reflecting plate 30 and the inner face of the transparent plastic plate 20. Thereby, the light reflecting plate 30 is sandwiched between the transparent plastic plate 20 and the thin transparent film 40 after the completion of assembly.

Figure 5:
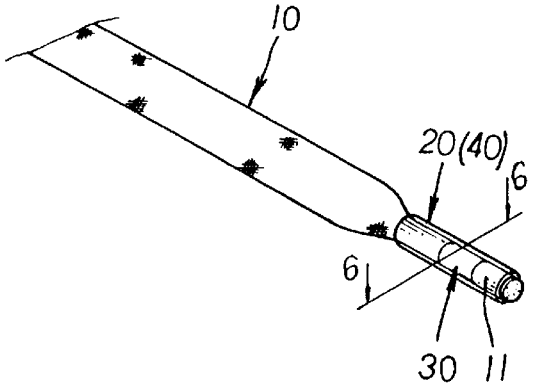
FIG. 5 is a diagram showing the securing of the tag to an end of a shoelace.
Figure 7:
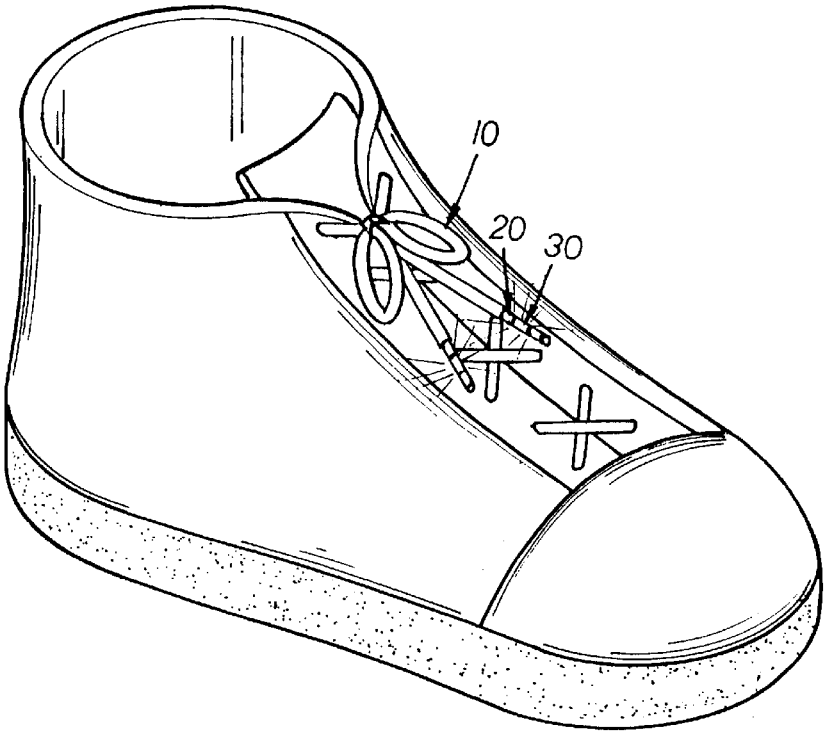
FIG. 7 is a diagram showing the practical application of the tags to the ends of a shoelace attached to a shoe.
Figure 6:
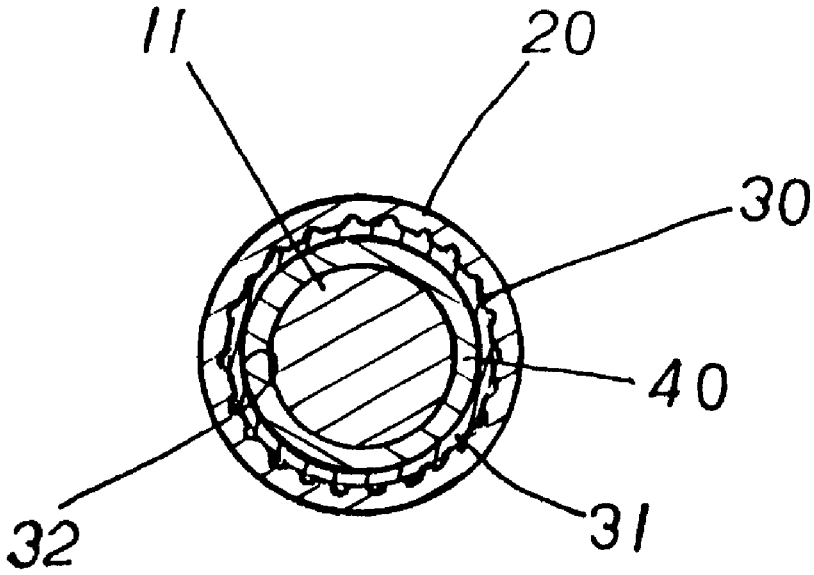
FIG. 6 is a sectional diagram taken along the sectional line 6—6 to show the structure of the tag.

Afterwards, the top face of the thin transparent film 40 is coated with acetone to permit the tag plate to be secured to each end 11 of a shoelace 10. The fixed tag is heated and softened by a heat source and is further pressed into a cylindrical shape to tightly wrap the tag plate around the end 11 of the shoelace 10, as shown in FIGS. 5, 6. Thereby, the shoelace 10 having two ends 11 fixed with a tag respectively can be easily and smoothly led through eyelets of a shoe 50, as shown in FIG. 7.

It is apparently seen that the improved tag of the present invention has the following advantages in practical use.

1. The ends 11 of the shoelaces 10 attached to a pair of shoes 50 can reflect light in the dark or in a situation in which light is dimmed, protecting people walking or exercising outdoors from accidental danger wearing such shoes.
2. The tags attached to the ends 11 of a shoelace 10 are reflective of light, making the appearance of shoes appealing to eyes in the dark.

I claim:

1. A shoelace and a tag for use on the shoelace of a shoe, comprising a transparent plastic plate; a light reflecting plate and a thin transparent film; wherein said light reflecting plate has one side provided with faceful bead protrusions and the other side is coated with adhesive glue; said tag is tightly wrapped around each end of a shoelace for easy attachment of a shoelace through eyelets of a shoe; said tag is characterized by that one inner side of said transparent plastic plate is engaged with the side with bead protrusions of said light reflecting plate and said other adhesive glued side of said light reflecting plate is fixed to said thin transparent film so as to permit said light reflecting plate to be sandwiched between said transparent plastic plate and said thin transparent film whereby said faceful bead protrusions of said light reflecting plate can reflect light in the dark for the purpose of safety and attractiveness.

2. The shoelace and tag as claimed in claim 1 wherein the side with faceful bead protrusions of said light reflecting plate is stuck to a central area of said inner side of said transparent plastic plate.

* * * * *